US005737953A

United States Patent [19]

Allison et al.

[11] Patent Number: 5,737,953

[45] Date of Patent: Apr. 14, 1998

[54] PROCESS FOR STRETCH FORMING HOLLOW METAL BODIES

[75] Inventors: Blair T. Allison, Cheswick, Pa.; Thomas J. VanSumeren, Waterford, Mich.; Robert P. Evert, Allison Park; John S. Schultz, McKeesport, both of Pa.

[73] Assignee: Aluminum Company of America, Pittsburgh, Pa.

[21] Appl. No.: 819,349

[22] Filed: Mar. 18, 1997

[51] Int. Cl.[6] ..... B21D 11/02

[52] U.S. Cl. ..... 72/58; 72/296

[58] Field of Search ..... 72/296, 297, 57, 72/58, 54; 29/421.1

[56] References Cited

U.S. PATENT DOCUMENTS 4,704,886 11/1987 Evert et al. ..... 72/57
4,788,843 12/1988 Seaman ..... 72/58
4,827,753 5/1989 Moroney ..... 72/296
4,970,886 11/1990 Sikora et al. ..... 72/302
5,327,764 7/1994 Weykamp ..... 72/296
5,349,839 9/1994 Weykamp et al. ..... 72/296

*Primary Examiner*—Daniel C. Crane
*Attorney, Agent, or Firm*—Glenn E. Klepac

[57] ABSTRACT

A process for stretch forming hollow metal bodies, such as aluminum alloy extrusions. The extrusions are stretched longitudinally, bent transversely of the pulling direction, and then subjected to pressure from an incompressible fluid in a hollow interior. In a preferred embodiment, the incompressible fluid is water at a pressure sufficient to deform at least part of the extrusion outwardly of its hollow interior. The incompressible fluid reduces dimensional distortions in the shaped product.

16 Claims, 2 Drawing Sheets

PROCESS FOR STRETCH FORMING HOLLOW METAL BODIES

FIELD OF THE INVENTION

The invention pertains to a process for shaping an elongated hollow metal body that is preferably an aluminum alloy extrusion. Shaped extrusions made by the process of the invention are used as vehicle body components.

BACKGROUND OF THE INVENTION

Aluminum alloy extrusions have long been used as components of vehicles, including automobiles, trucks, boats and aircraft. Such extrusions are typically made by a process wherein a heated ingot or billet is forced through a die opening under pressure to form an elongated body such as a channel, tube or angle. The extruded product is generally forced through a die at forces in the 500 to 15,000 ton range. The extrusion exits the die at elevated temperatures on the order of 300°–1200° F. The extruded product is then commonly solution heat treated and quenched. The product may be made to various lengths, including lengths in excess of 150 feet, and may have any of a diverse variety of cross-sectional configurations.

In order for the extrusions to be suitable as vehicle body components such as automobile roof rails, they must be shaped into more complex configurations. Some processes employed in the prior art for shaping aluminum alloy extrusions include bending, stretch-forming and stretch-wrap forming. These prior art processes perform adequately in instances where the degree of deformation is small or where dimensional tolerances are large. However, there is still a need for an improved shaping process when large deformations are required and dimensional tolerances are small.

A principal objective of the present invention is to provide a process for stretch-forming hollow metal bodies wherein an incompressible fluid means is pressurized inside the bodies in order to reduce deviations from dimensional limits.

A related objective of the invention is to provide a process for stretch-forming hollow metal bodies wherein the bodies undergo smaller deviations from desired dimensions than in the prior art.

Additional objectives and advantages of the invention will become apparent to persons skilled in the art from the following specification and claims.

SUMMARY OF THE INVENTION

In accordance with the present invention, there is provided a process for forming elongated hollow metal bodies into desired shapes. The hollow metal bodies are preferably aluminum alloy extrusions.

Some preferred aluminum alloys for the extrusions of the invention are aluminum-copper alloys of the AA 2000 series, aluminum-magnesium-silicon alloys of the AA 6000 series and aluminum-zinc alloys of the AA 7000 series. Extrusions preferred for use in the automotive and aircraft industries that may be stretch formed by the present invention include, but are not limited to, the AA 2024, 6061, 60063, 6009 and 7075 aluminum alloys.

Extrusions that are shaped in accordance with the invention are elongated hollow bodies having opposed, longitudinal end portions. The extrusions generally start with a substantially uniform cross section from end to end.

End portions of the extrusions are gripped by the jaws of opposed grippers and the extrusion is encapsulated in a flexible constraining apparatus or tooling that surrounds at least a portion of the outer periphery. The constraining apparatus preferably surrounds substantially the entire periphery. One suitable apparatus is shown and described in Weykamp U.S. Pat. No. 5,349,839, which is incorporated by reference to the extent consistent with the present invention. The flexible constraining apparatus resists formation of wrinkles and bulges in the extrusion while it is being deformed. The extrusion is then stretched longitudinally by pulling the end portions in opposite directions. Sufficient force is exerted on the grippers to exceed an elastic limit so that elongation through plastic deformation is initiated.

While the extrusion is being stretched longitudinally, it is bent transversely of the direction of pulling. Bending is preferably accomplished by moving the extrusion forcibly against a forming die or shaping die. Sufficient force is exerted to impart a contour to the extrusion similar to the forming die contour.

At least one of the end portions of the extrusion is plugged by a sealing plug. Preferably, both end portions are plugged. The sealing plugs have ports through which an incompressible fluid or fluid means is transmitted into a hollow interior of the extrusion and removed therefrom. A preferred incompressible fluid is water, preferably water containing an anti-rust agent to minimize damage to pipes, valves and gauges in the apparatus. Some other suitable incompressible fluids include mineral oil, silicone oil, polyglycols and mixtures of polyglycols with water. Compressible fluids such as air are unsuitable because of safety hazards they pose to operators of the apparatus at high pressures.

The incompressible fluid is pressurized in a hollow interior of the extrusion after the extrusion is bent transversely. The fluid has sufficient pressure to deform at least part of the body outwardly of its hollow interior. In this step, the water has a pressure of about 100–5,000 psi (0.7–35 MPa), preferably about 100–3,000 psi (0.7–21 MPa).

The fluid may also be introduced under pressure into the interior while the extrusion is being bent transversely. Here, the fluid has an initial pressure of less than about 100 psi (0.7 MPa), preferably in the range of about 0–50 psi (0–0.35 MPa). This pressure is sufficient to reduce undesired distortions in the extrusion during transverse bending.

DETAILED DESCRIPTION OF THE PREFERRED EMBODIMENTS

Figure 1:
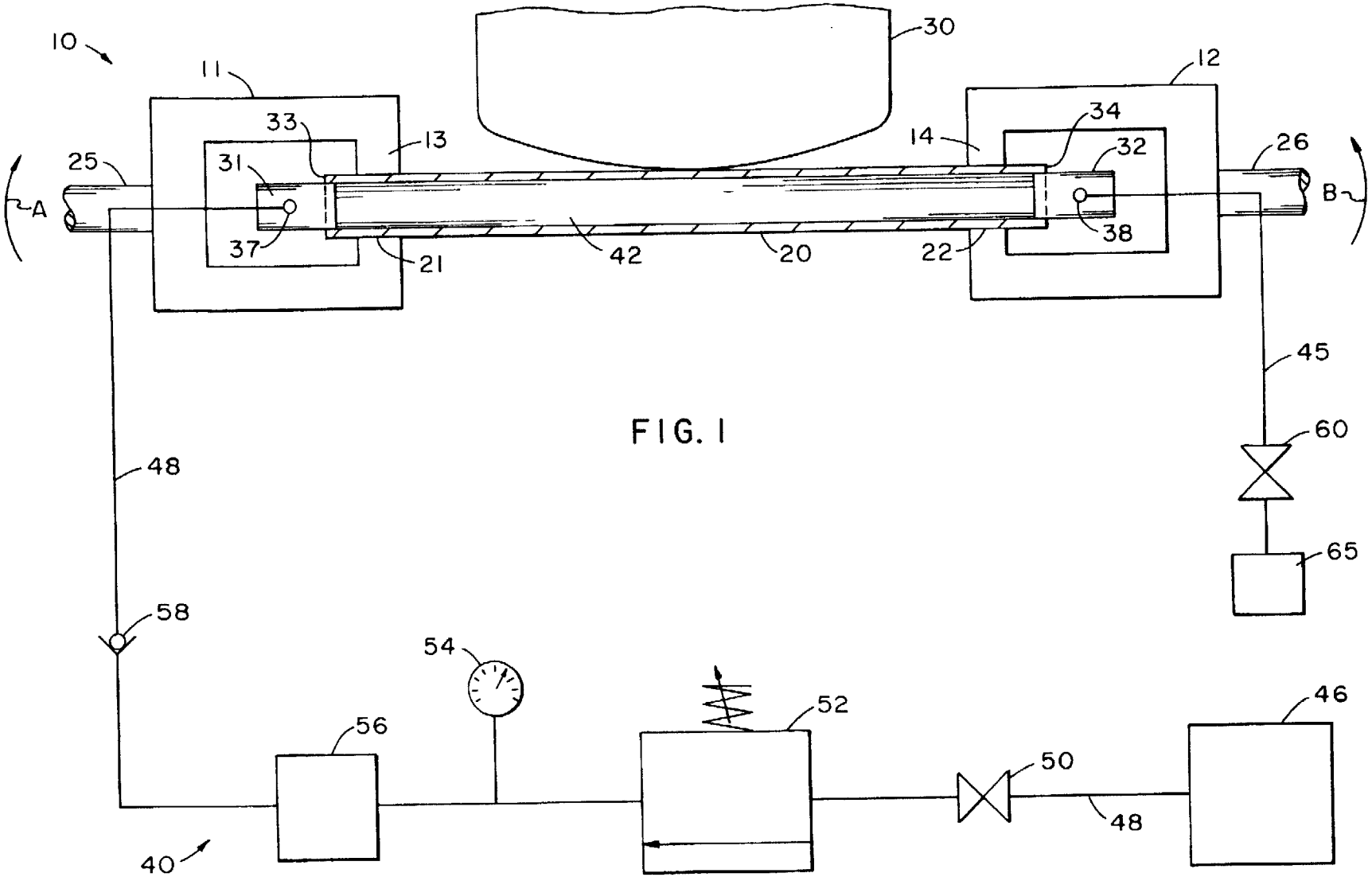
FIG. 1 is a schematic illustration of an apparatus for forming hollow metal bodies in accordance with the present invention.

In the process of the present invention, aluminum alloy extrusions are stretch-formed into shapes that are useful as vehicle body components such as automobile roof rails. A stretch-forming apparatus 10 for carrying out the process of the invention is shown in FIG. 1.

The apparatus 10 includes a pair of opposed grippers or gripper assemblies 11, 12 having jaws 13, 14 for gripping portions of an aluminum alloy extrusion 20. A first jaw 13 gasps a first end portion 21 and a second jaw 14 gasps a second end portion 22 of the extrusion 20. The jaws 13, 14 selectively grip and release the end portions 21, 22 upon command from an operator (not shown) of the apparatus 10.

The gripper assemblies 11, 12 are carried by the outer ends of piston rods 25, 26 of hydraulic cylinder assemblies (not shown). The cylinder assemblies support the gripper assemblies 11, 12 and are carded by adjustable mountings (not shown) to permit rotary movement in the direction of arrows A, B with respect to a forming die or shaping die 30. This is accomplished by moving the die 30 into the extrusion 20. Alternatively, the gripper assemblies 11, 12 are swung back in the direction of arrows A, B.

The piston rods 25, 26 cooperate with hydraulic cylinders to stretch the extrusion 20 a preselected magnitude. At the same time, rotary movement of the gripper assemblies 11, 12 as indicated by the arrows A, B forms the extrusion 20 over the forming die 30. For parts having more complex shapes, the gripper assemblies 11, 12 may also be moved upwardly or downwardly or they may be twisted.

Each gripper assembly 11, 12 includes a plug or plug means 31, 32 having a size and shape enabling it to engage and seal an open end 33, 34 of the extrusion 20. A fluid-tight connection is established and maintained between the plugs 31, 32 and the open ends 33, 34. One plug 31 has a fluid inlet port 37 and the other plug 32 has a fluid outlet port 38. The fluid inlet port 37 is connected to a fluid supply system 40 that provides fluid to a hollow interior 42 of the extrusion 20. The outlet port 38 is connected to a fluid bleed line 45 for evacuating the incompressible fluid from the interior 42.

The fluid supply system 40 includes a pressurized fluid reservoir 46 connected by a conduit 48 with the inlet port 37. The conduit 48 defines a flow path that includes a stop valve 50, an adjustable flow control valve 52, a pressure gauge 54, a filter canister 56 and a one-way (non-backflow) check valve 58.

The fluid bleed line 45 has an automatically operated, pressure bleed valve 60. Incompressible fluid 65 exiting through the bleed line 45 may be sent to a waste treatment plant (not shown) for disposal. More preferably, the used fluid 65 is recycled back to the fluid reservoir 46 for reuse in the fluid supply system 40.

An extrusion 20 is loaded into the apparatus 10. The extrusion 20 preferably is made from an AA 6061 alloy in the T4temper. The extrusion is snugged against opposed lateral sides of a die 30. Gripper jaws 13, 14 firmly grasp the end portions 21, 22. Water is introduced through the inlet port 37 into the interior 42 of the extrusion 20. A fluid pressure of approximately 10 psi (0.07 MPa) is particularly preferred. Once filled, the fluid volume is kept constant by shutting off the stop valve 50 and the bleed valve 60. A low fluid pressure on the order of approximately 0–20 psi is preferred so that the extrusion 20 does not bulge when it is stretched and bent.

The extrusion 20 is stretched longitudinally by moving the piston rods 25, 26 outwardly. The piston rods 25, 26 are then rotated in the direction of the arrows A, B shown in FIG. 1 to bend the extrusion 20 in conformity with the die 30.

After the extrusion 20 is bent to a desired shape and while the extrusion 20 conforms to the die 30, external tooling (not shown) is moved into a position adjacent the extrusion 20 and clamped in place to support the outer surface of the extrusion 20. The external tooling resists formation of wrinkles and bulges in the extrusion during deformation. Then, with tension still being maintained on the rods 25, 26, the valve 58 is opened. Water under a pressure of about 2,500 psi (17.3 MPa) is introduced into the hollow interior 42 and kept there for about one or two seconds. Water 65 is vented from the interior 42 through the bleed line 45, tension on the end portions 21, 22 is relaxed, and the gripper jaws 13, 14 are released.

Figure 2:
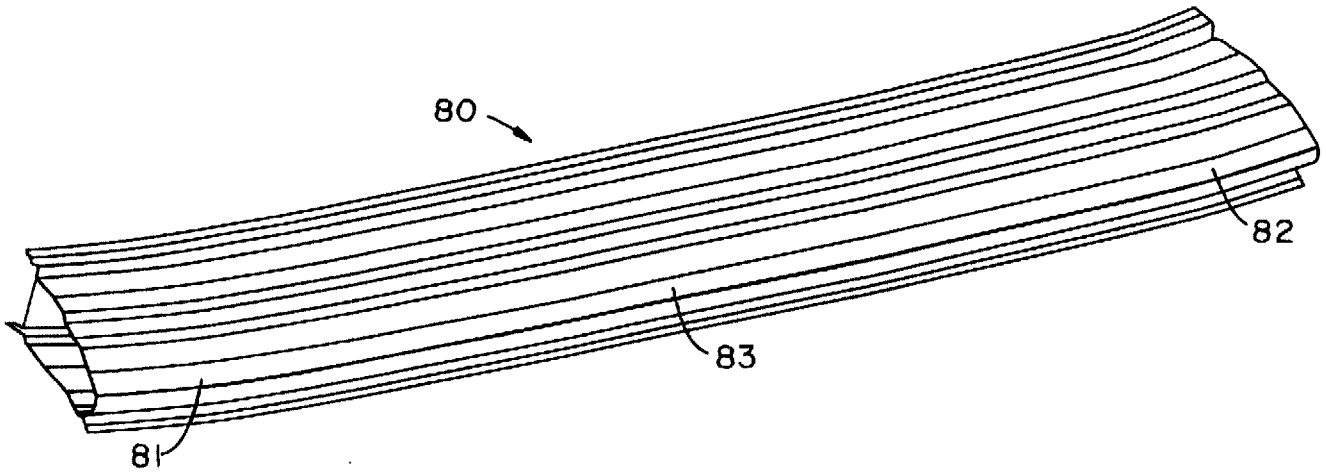
FIG. 2 is a perspective view of an aluminum alloy extrusion that has been formed in accordance with the invention.

A shaped extrusion 80 made in accordance with our invention is shown in FIG. 2. The extrusion 80 has a first end portion 81, a second end portion 82 and a center portion 83. The first end portion 81 has a bend radius of about 7 times the part depth (7D bend). The second end portion 82 has a bend radius of about 4 times the part depth (4D bend). The center portion 83 has a bend radius of about 65 times the part depth (65D bend). Our experience with prior art bending methods is that dimensional tolerance problems are to be expected in the end portions 81, 82 because of their tighter bend radii.

We measured deviations from desired dimensions on the extrusion 80, before and after pressuring internally with water at 500 psi (3.5 MPa). Deviations of 1.7 mm and 1.8 mm were both reduced to 0.2 mm or less in two examples.

Having described the presently preferred embodiments, it is to be understood that the invention may be otherwise embodied within the scope of the appended claims.

What is claimed is:

1. A process for forming into a desired shape an elongated hollow metal body having opposed longitudinal end portions, comprising:

(a) gripping said end portions of the body with grippers;

(b) stretching said body longitudinally by pulling said end portions in opposite directions with sufficient force to exceed an elastic limit and to initiate elongation through plastic deformation;

(c) while stretching said body longitudinally, bending the body between its ends transversely of the direction of the pulling; and (d) after step (c) and while continuing to pull said end portions, pressurizing a hollow interior of the body with an incompressible fluid means at a pressure sufficient to deform at least part of the body outwardly of said interior.

2. The process of claim 1 further comprising:

(e) relaxing said pulling and said pressurizing.

3. The process of claim 1 further comprising:

(e) while bending said body transversely, supporting said body internally with an incompressible fluid means contacting an interior wall of said body.

4. The process of claim 3 wherein said body comprises an aluminum alloy extrusion and said fluid means has a pressure of less than about 100 psi (0.7 MPa) in step (e).

5. The process of claim 1 wherein said body comprises an aluminum alloy extrusion and said fluid means has a pressure of about 100–5,000 psi (0.7–35 MPa) in step (d).

6. The process of claim 1 wherein said body is an aluminum alloy extrusion comprising an alloy of the AA 2000, 6000 or 7000 series.

7. The process of claim 1 wherein said fluid means comprises water.

8. The process of claim 7 wherein said water contains an anti-rust agent.

9. The process of claim 1 wherein said fluid means is selected from the group consisting of water, mineral oil, silicone oil, polyglycols and polyglycol-water mixtures.

10. The process of claim 1 wherein step (d) includes plugging at least one of said end portions with a sealing plug having a port through which said incompressible fluid means is transmitted into said interior.

11. A process for forming aluminum alloy extrusions into shapes suitable for use as vehicle body components, comprising:

(a) gripping opposed longitudinal end portions of an aluminum alloy extrusion with grippers;

(b) stretching said extrusion longitudinally by pulling said end portions in opposite directions with sufficient force to exceed an elastic limit of the extrusion and to initiate elongation through plastic deformation;

(c) while stretching said extrusion longitudinally, bending it between its ends transversely of the direction of pulling; and (d) after step (c) and while continuing to pull said end portions, pressurizing a hollow interior of the extrusion with an incompressible fluid means comprising water at a pressure in the range of about 100–5,000 psi, said pressure being sufficient to deform at least part of the extrusion outwardly of said interior.

12. The process of claim 11 further comprising:

(e) while bending said extrusion transversely of the direction of pulling, supporting said extrusion internally with said incompressible fluid means.

13. The process of claim 12 wherein said incompressible fluid means has a pressure of less than about 100 psi (0.7 MPa) in step (e).

14. The process of claim 11 wherein said extrusion comprises an aluminum alloy of the AA 6000 series.

15. The process of claim 11 wherein said water contains an anti-rust agent.

16. The process of claim 11 wherein said water has a pressure of about 3000 psi (0.7–21 MPa) in step (d).

* * * * *